US005966894A

United States Patent [19]

Crump, Jr.

[11] Patent Number: 5,966,894

[45] Date of Patent: Oct. 19, 1999

[54] MODULAR INSULATED FRAMING BEAM ASSEMBLY

[76] Inventor: Preston L. Crump, Jr., P.O. Box 937, Mt Pleasant, N.C. 28124

[21] Appl. No.: 08/982,660

[22] Filed: Dec. 2, 1997

[51] Int. Cl.[6] ..... E04C 3/14; E04C 3/29

[52] U.S. Cl. ..... 52/729.4; 52/404.3; 52/407.3; 52/729.2; 52/730.7; 52/731.3

[58] Field of Search ..... 52/404.3, 407.3, 52/407.4, 729.2, 729.4, 730.1, 730.7, 731.3, 732.2

[56] References Cited

U.S. PATENT DOCUMENTS

| | | | |
|---|---|---|---|
| 3,531,901 | 10/1970 | Will, Jr. et al. | 52/730.1 X |
| 3,693,304 | 9/1972 | Shell . | |
| 4,329,827 | 5/1982 | Thorn | 52/730.7 |
| 4,409,769 | 10/1983 | Redman . | |
| 4,601,144 | 7/1986 | Tinti . | |
| 4,674,250 | 6/1987 | Altizer . | |
| 4,765,105 | 8/1988 | Tissington . | |
| 4,852,322 | 8/1989 | McDermid | 52/729.4 X |
| 5,079,885 | 1/1992 | Dettbarn | 52/407.3 X |
| 5,095,671 | 3/1992 | Mitani . | |
| 5,115,609 | 5/1992 | Sing | 52/730.7 |
| 5,279,089 | 1/1994 | Gulur . | |
| 5,497,595 | 3/1996 | Kalinin . | |
| 5,653,080 | 8/1997 | Bergeron | 52/729.4 |

*Primary Examiner*—Christopher T. Kent
*Assistant Examiner*—Timothy B. Kang
*Attorney, Agent, or Firm*—Adams Law Firm, P.A.

[57] ABSTRACT

A modular, insulated framing beam assembly is adapted for residing at a head of a door or window frame. The beam assembly includes an elongate top framing member having first and second opposed ends, first and second opposed sides, and top and bottom major surfaces. The top framing member includes a pair of laterally-spaced and longitudinally-extending grooves formed in its bottom major surface. An elongate bottom framing member resides in spaced, vertical registration with the top framing member. The bottom framing members has first and second opposed ends, first and second opposed sides, and top and bottom major surfaces. The bottom framing member includes a pair of laterally-spaced and longitudinally-extending grooves formed in its top major surface. First and second laterally-spaced side framing members are positioned in respective pairs of laterally-spaced grooves formed in the top and bottom framing members. A core insulating member is sandwiched between the first and second side framing members and the top and bottom framing members for insulating the framing beam assembly.

13 Claims, 4 Drawing Sheets

MODULAR INSULATED FRAMING BEAM ASSEMBLY

TECHNICAL FIELD AND BACKGROUND OF THE INVENTION

This invention relates to a modular insulated framing beam assembly. The invention is especially applicable for use in stick-built residential construction as a header for door and window frames. The invention provides a preformed, modular structural component which is readily and conveniently incorporated into the framing assembly.

Standard load-bearing headers are typically formed of two 2×10 wood segments and two 2×4 wood segments of equal lengths. The 2×10s are arranged side-by-side and nailed together to define the body of the header. The 2×4 wood segments are nailed, respectively, to opposed longitudinal side edges of the attached 2×10s to form the top and bottom of the header. The header is generally constructed on-site, and does not include insulating material. The resulting R-value of the header is therefore minimal.

The term "R-value" as used herein refers to the measure of the ability of an insulating structure to retard the flow of heat. The higher the R-value, the greater the insulation. Standard building codes in southeastern States typically require an R-value of 13 for exterior walls in residential construction.

The present invention overcomes many disadvantages of standard, site-constructed headers by providing a framing beam assembly which is preformed and insulated. The invention further has sufficient structural integrity to provide a load-bearing capacity comparable to standard headers without insulation.

SUMMARY OF THE INVENTION

Therefore, it is an object of the invention to provide a framing beam assembly which is applicable for use as a header for door and window frames.

It is another object of the invention to provide a framing beam assembly which is a preformed, modular structure.

It is another object of the invention to provide a framing beam assembly which is insulated.

It is another object of the invention to provide a framing beam assembly which has a relatively high load-bearing capacity.

It is another object of the invention to provide a framing beam assembly which has a relatively high R-value.

It is another object of the invention to provide a framing beam assembly which is relatively lightweight and compact.

These and other objects of the present invention are achieved in the preferred embodiments disclosed below by providing a modular, insulated framing beam assembly adapted for residing at a head of a door or window frame. The beam assembly includes an elongate top framing member having first and second opposed ends, first and second opposed sides, and top and bottom major surfaces. The top framing member includes a pair of laterally-spaced and longitudinally-extending grooves formed in its bottom major surface.

An elongate bottom framing member resides in spaced, vertical registration with the top framing member. The bottom framing member has first and second opposed ends, first and second opposed sides, and top and bottom major surfaces. The bottom framing member includes a pair of laterally-spaced and longitudinally-extending grooves formed in its top major surface.

First and second laterally-spaced side framing members are positioned in respective pairs of laterally-spaced grooves formed in the top and bottom framing members. A core insulating member is sandwiched between the first and second side framing members and the top and bottom framing members for insulating the framing beam assembly.

According to one preferred embodiment of the invention, the respective pairs of grooves formed in the top and bottom framing members extend longitudinally from one end of the framing members to the other.

According to another preferred embodiment of the invention, the first and second side framing members are secured within the grooves of the top and bottom framing members by an adhesive.

According to one preferred embodiment of the invention, the first and second side framing members are formed of plywood.

According to another preferred embodiment of the invention, the first and second side framing members are formed of wafer board.

According to yet another preferred embodiment of the invention, the core insulating member includes fiber insulation.

According to yet another preferred embodiment of the invention, the core insulating member includes polystyrene plastic.

Preferably, the core insulating member has an R-value of at least 7.

According to another preferred embodiment of the invention, first and second side insulating members reside adjacent respective first and second side framing members.

According to one preferred embodiment of the invention, the side insulating members includes polystyrene plastic.

According to another preferred embodiment of the invention, the side insulating members include fiber insulation.

Preferably, each of the first and second side insulating members has an R-value of at least 5.

According to another preferred embodiment of the invention, first and second side mounting strips reside adjacent respective first and second side framing members. The mounting strips are adapted for receiving fasteners for attaching adjacent structures to the beam assembly.

Preferably, the side mounting strips are formed of wood.

Preferably, the top and bottom framing members are formed of wood.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
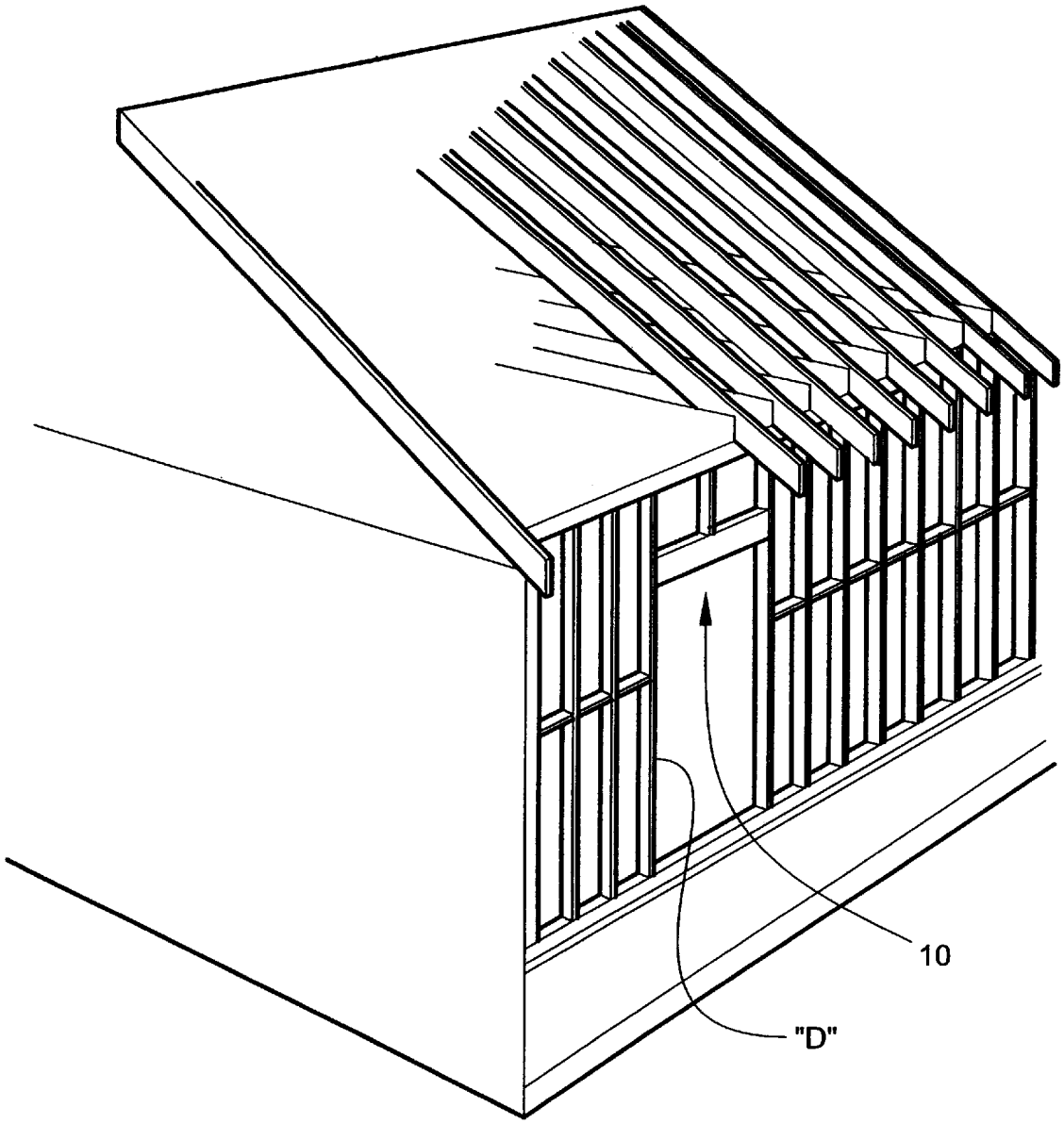
FIG. 1 is an environmental perspective view of an insulated, modular framing beam assembly according to one preferred embodiment of the invention, and showing the framing beam in position at the head of a door frame.

Referring now specifically to the drawings, an insulated framing beam assembly according to the present invention is illustrated in FIG. 1 and shown generally at reference numeral 10. The beam assembly 10 is especially applicable for use in stick-built residential construction as a load-bearing header for a door frame "D" or a window frame (not shown). The length, width, and height dimensions of the beam assembly 10 correspond generally to those of a standard, site-constructed header.

Figure 2:
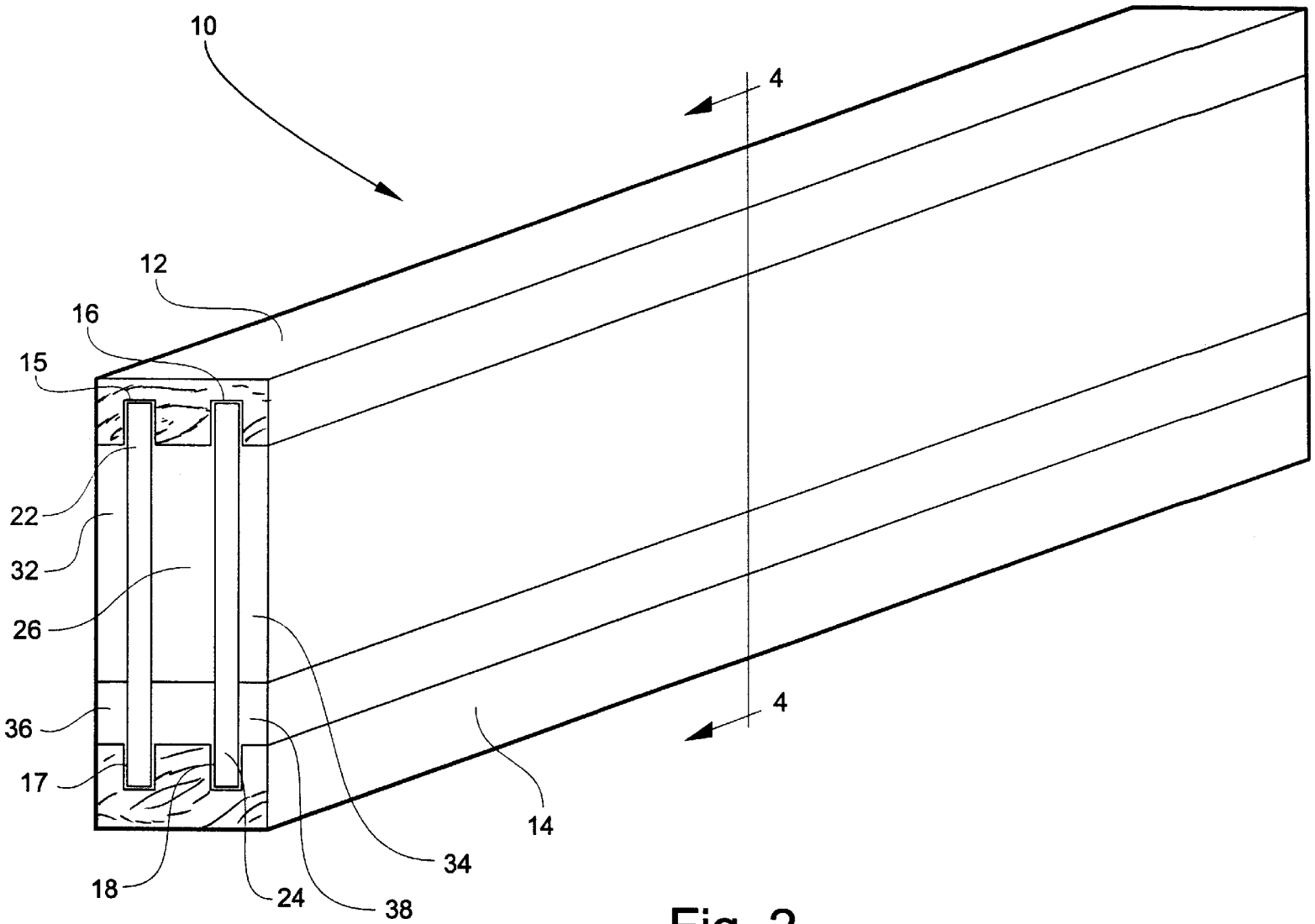
FIG. 2 is a perspective view of the framing beam assembly.
Figure 3:
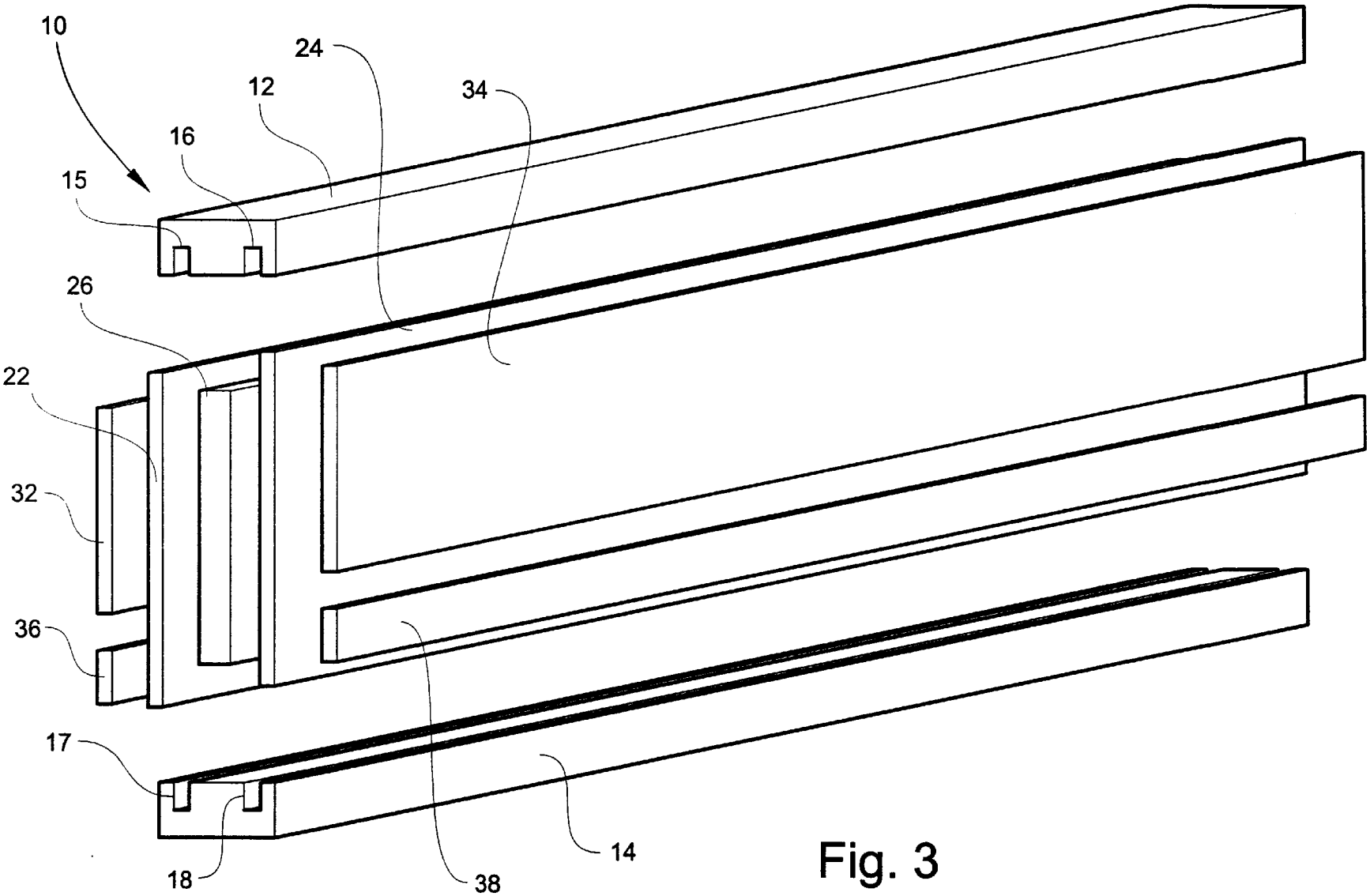
FIG. 3 is an exploded view of the framing beam assembly.
Figure 4:
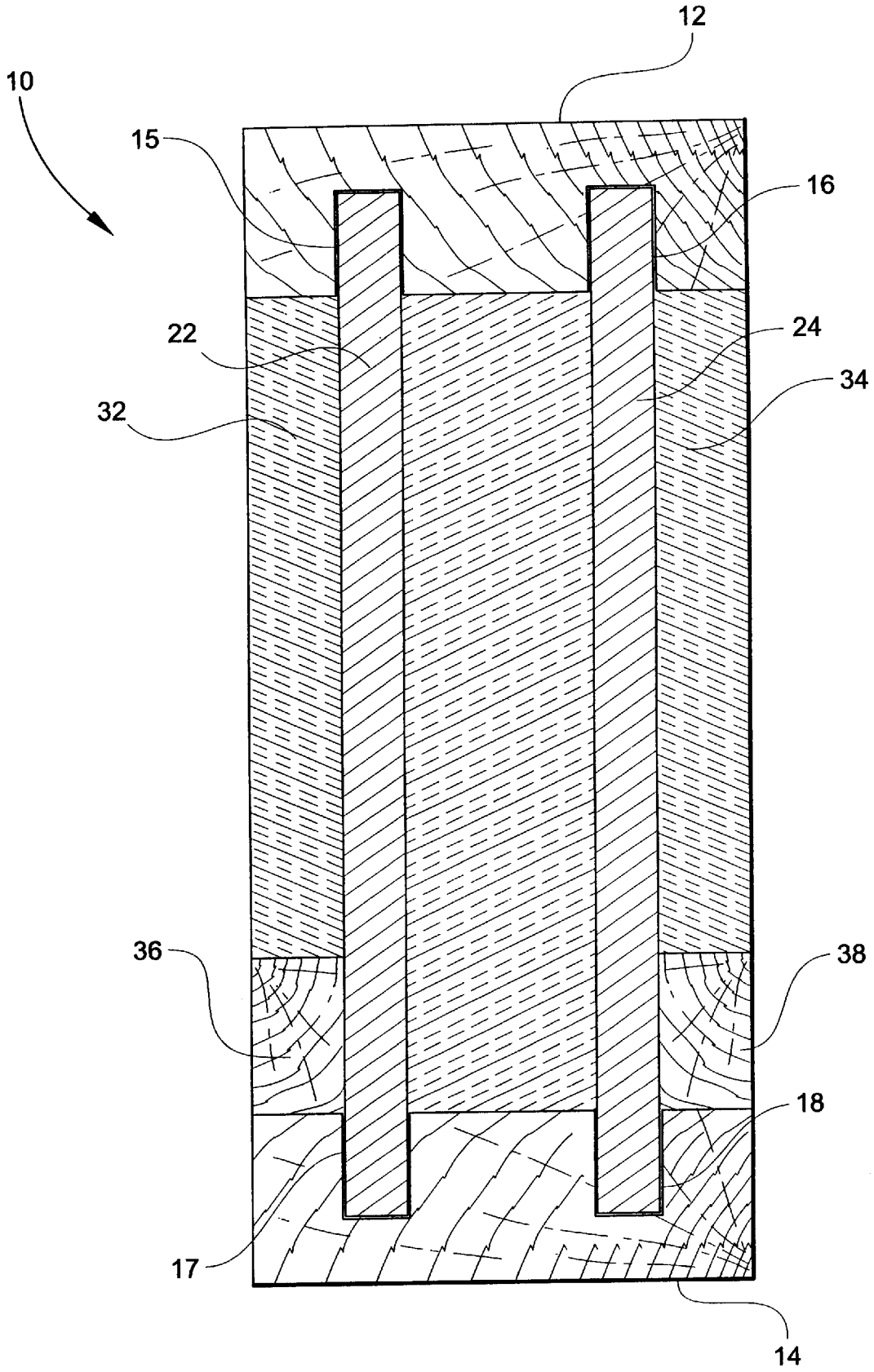
FIG. 4 is a cross-sectional view taken along line 4—4 of FIG. 2.

Referring to FIGS. 2, 3, and 4, the beam assembly 10 includes top and bottom spaced-apart framing members 12 and 14 arranged in vertical registration, and having respective first and second opposed ends, first and second opposed sides, and top and bottom major surfaces. A pair of laterally-spaced grooves 15 and 16 are formed in the bottom major surface of the top framing member 12, and preferably extend the entire length of the framing member 12 from one end to the other. The bottom framing member 14 has a corresponding pair of laterally-spaced grooves 17 and 18 formed in its top major surface. The framing members 12 and 14 are preferably constructed of 2×4 wood segments.

First and second side framing members 22 and 24 are edge-positioned in respective grooves 15, 16, 17, and 18 of the top and bottom framing members 12 and 14, and extend the entire length of the beam assembly 10 from one end to the other. The side framing members 22 and 24 are permanently attached to the top and bottom framing members 12 and 14 using an adhesive, nails, or other suitable fastener. According to one embodiment, the side framing members 22 and 24 are formed of a relatively lightweight wood product, such as plywood or wafer board, and are each about ⅜ inches wide.

A core insulating member 26 is sandwiched between the top and bottom framing members 12 and 14 and first and second side framing members 22 and 24 for insulating the interior of the beam assembly 10. The insulating member 26 is preferably formed of an expanded, rigid polystyrene plastic, such as STYROFOAM™. Alternatively, the insulating member 26 is formed of standard paper-backed fiber insulation, or loose fiber insulation contained between the framing members 12, 14, 22, and 24. The width of the core insulating member 26 is about 1¼ inches, providing an R-value of about 7.5.

Preferably, first and second side insulating members 32 and 34 reside adjacent respective side framing members 22 and 24 and the top framing member 12 to further insulate the beam assembly 10. The side insulating members 32 and 34 are likewise formed of an insulating material, such as STYROFOAM™, and are permanently adhered to each of the side framing members 22 and 24 using an adhesive. Alternatively, the insulating members 32 and 34 are formed of a paper-backed fiber insulation. The width of each side insulating member 32, 34 is about ¾ inches, providing an R-value of about 5.6.

First and second mounting strips 36 and 38 are located beneath the side insulating members 32 and 34 and adjacent the side framing members 22 and 24 and bottom framing member 14. The mounting strips 36 and 38 are preferably formed of plywood, and are permanently attached to the side framing members 22 and 24 using an adhesive or other fastener. The mounting strips 36 and 38 provide an attachment site along the entire length of the beam assembly 10 for attaching other structures, such as exterior siding and sheet rock, to the beam assembly 10.

The overall R-value for the beam assembly 10, described above, is about 18.7. This value is readily adjusted by increasing or decreasing the thickness of the core insulating member 26 and side insulating members 32 and 34, and/or selecting an alternative insulating material in order to satisfy the requirements of the particular structure.

A modular, insulated framing beam assembly is described above. Various details of the invention may be changed without departing from its scope. Furthermore, the foregoing description of the preferred embodiment of the invention and the best mode for practicing the invention are provided for the purpose of illustration only and not for the purpose of limitation--the invention being defined by the claims.

I claim:

1. A modular, insulated framing beam assembly adapted for residing at a head of a door or window frame, said beam assembly comprising:

(a) an elongate top framing member having first and second opposed ends, first and second opposed sides, and top and bottom major surfaces, said top framing member including a pair of laterally-spaced and longitudinally-extending grooves integrally formed in its bottom major surface;

(b) an elongate bottom framing member positioned in spaced, vertical registration with said top framing member, and having first and second opposed ends, first and second opposed sides, and top and bottom major surfaces, said bottom framing member including a pair of laterally-spaced and longitudinally-extending grooves integrally formed in its top major surface;

(c) first and second laterally-spaced side framing members positioned in said respective pairs of laterally-spaced grooves formed in said top and bottom framing members; and (d) a core insulating member sandwiched between respective inside surfaces of said first and second side framing members and said top and bottom framing members for insulating said framing beam assembly;

(e) first and second longitudinally-extending side insulating members positioned against respective outside surfaces of said first and second side framing members to further insulate said framing beam assembly; and (f) first and second longitudinally-extending side mounting strips positioned generally co-planer to respective first and second side insulating members and against respective outside surfaces of said first and second framing members, said mounting strips being adapted for receiving fasteners therein for attaching other structures to said beam assembly.

2. A beam assembly according to claim 1, wherein said respective pairs of grooves formed in said top and bottom framing members extend longitudinally from one end of said framing members to the other.

3. A beam assembly according to claim 2, wherein said first and second side framing members are secured within the grooves of said top and bottom framing members by an adhesive.

4. A beam assembly according to claim 1, wherein said first and second side framing members are formed of plywood.

5. A beam assembly according to claim 1, wherein said first and second side framing members are formed of wafer board.

6. A beam assembly according to claim 1, wherein said core insulating member comprises fiber insulation.

7. A beam assembly according to claim 1, wherein said core insulating member comprises polystyrene plastic.

8. A beam assembly according to claim 1, wherein said core insulating member has an R-value of at least 7.

9. A beam assembly according to claim 1, wherein said side insulating members comprise polystyrene plastic.

10. A beam assembly according to claim 1, wherein said side insulating members comprise fiber insulation.

11. A beam assembly according to claim 1, wherein each of said first and second side insulating members has an R-value of at least 5.

12. A beam assembly according to claim 1, wherein said side mounting strips are formed of wood.

13. A beam assembly according to claim 1, wherein said top and bottom framing members are formed of wood.

* * * * *